United States Patent [19]

Kuratani

[11] 4,410,873

[45] Oct. 18, 1983

[54] ROTARY VARIABLE RESISTOR

[75] Inventor: Junichi Kuratani, Miyagi, Japan

[73] Assignee: Alps Electric Co., Ltd., Japan

[21] Appl. No.: 320,517

[22] Filed: Nov. 12, 1981

[30] Foreign Application Priority Data

Nov. 12, 1980 [JP] Japan ..... 55-161649[U]

[51] Int. Cl.[3] ..... H01C 10/30

[52] U.S. Cl. ..... 338/160; 338/119; 338/162; 338/174; 338/196

[58] Field of Search ..... 338/160, 162, 174, 135, 338/137, 119, 196; 200/11 TW

[56] References Cited

U.S. PATENT DOCUMENTS

| | | | |
|---|---|---|---|
| 2,205,380 | 6/1940 | Batcheller | 200/316 X |
| 2,798,924 | 7/1957 | Kimball | 200/316 |
| 3,223,490 | 12/1965 | Huntress et al. | 200/316 |
| 3,416,119 | 12/1968 | Van Benthuysenetol | 200/11 TW X |
| 3,435,167 | 3/1969 | Pfleger | 200/11 TW |
| 3,654,413 | 4/1972 | Jordan et al. | 200/156 |
| 3,677,619 | 7/1972 | MacKenzie | 116/DIG. 5 |
| 3,743,999 | 7/1973 | Miyashita | 338/160 X |
| 3,914,728 | 10/1975 | Nishioka et al. | 338/196 X |
| 3,935,555 | 1/1976 | Nishioka et al. | 338/174 |
| 3,943,815 | 3/1976 | Gilbert | 350/96.24 X |
| 3,997,864 | 12/1976 | Oka et al. | 338/119 |
| 4,112,278 | 9/1978 | Greiner et al. | 200/11 TW X |
| 4,139,949 | 2/1979 | Goldman | 116/DIG. 26 X |

FOREIGN PATENT DOCUMENTS

| | | | |
|---|---|---|---|
| 2046252 | 6/1971 | Fed. Rep. of Germany | 200/11 TW |
| 2522210 | 11/1976 | Fed. Rep. of Germany | 200/316 |
| 2545369 | 4/1977 | Fed. Rep. of Germany | 200/316 |
| 2741492 | 3/1979 | Fed. Rep. of Germany | 200/316 |

OTHER PUBLICATIONS

IBM Technical Disclosure vol. 19 No. 5 Oct. 1976.

*Primary Examiner*—C. L. Albritton

*Attorney, Agent, or Firm*—Guy W. Shoup; Gerard F. Dunne

[57] ABSTRACT

A rotary variable resistor wherein a pair of levers are arranged in a case, a knife-shaped cam has its one end pivotally mounted on a projection of each lever, and the cam comes into engagement with a tooth portion of a toothed wheel in accordance with the operation of the lever so as to turn a slider holder. The moving stroke of the lever can be made small, and the slider holder can be turned every small angle.

5 Claims, 13 Drawing Figures

ROTARY VARIABLE RESISTOR

BACKGROUND OF THE INVENTION

The present invention relates to a rotary variable resistor. More particularly, it relates to a rotary variable resistor of the type wherein a resistance value can be varied by turning a holder for a slider in either its forward or reverse direction by means of a pair of levers mounted on a case.

FIG. 9 illustrates a known structure for turning a slider holder and, as shown, a slider holder 27 is rotated by a lever 28 movable vertically to engage tooth portions 27*a* of the slider holder in its downward stroke. In its inoperative state, the lever 28 must lie outside the turning range of the tooth portions 27*a*. Therefore, when the lever 28 is moved to turn the slider holder 27, it moves a distance l before engaging a tooth portion 27*a*, and this results in considerable play, and the moving stroke of the lever 28 becomes large. Another problem of such structure is that the pitch of the tooth portions 27*a* cannot be made small and thus the slider holder 27 cannot be turned through a small angle.

SUMMARY OF THE INVENTION

The present invention has been made to overcome the disadvantages described above, and has for its object to provide inexpensively a rotary variable resistor of the specified type whose operation is reliable, the stroke of the levers is small and which can turn a slider receiver through a small angle.

In order to accomplish the object, according to the present invention, a rotary variable resistor is provided with a case and two levers which are arranged on opposing sides of said case. Two cams are also provided and one end part of each cam is pivotally mounted on a respective lever. The cams are formed with an indent in a position close to the connection to the levers and edge portion of each cam extends inwardly of said case in such a manner that a cam keeper provided in said case abuts on said indent. A slider holder and a toothed wheel which are rotatably arranged in a central part of said case sliders adapted to engage arcuate resistors formed on an insulating base plate. The levers can be vertically moved to cause the edge portion of the corresponding cam to turn said toothed wheel and said slider holder and thus cause said sliders to slide on said arcuate resistors, whereby a resistance value of said variable resistor is varied.

BRIEF DESCRIPTION OF THE DRAWINGS

All of FIGS. 1 to 8 show an embodiment of the present invention, in which.

PREFERRED EMBODIMENT OF THE INVENTION

Hereunder, the present invention will be described in detail with reference to the drawings.

Numeral 1 designates a box-shaped insulating case which is made of a synthetic resin. The insulating case 1 includes an upstanding side wall portion 1*a*, a lower wall portion 1*b*, and an upper wall portion 1*d*. An overhang portion 1*c* extends upwardly from the top of the lower wall portion 1*b*, and serves to hold a cover 13 to be mounted on the case 1. The case 1 includes two arms 1*a*′ extending upwardly from opposite sides of the lower wall portion 1*b*. Between each arm 1*a*′ and the adjacent side wall portion 1*a* are formed respective recesses 1*e* and 1*e*′. A respective elongate lever 2 having a generally square cross-section is disposed in each larger recess 1*e*, while a respective coiled spring 3 is disposed in each smaller recess 1*e*′ . The fore end of each arm 1*a*′ is provided with a cam keeper 1*f* extending outwardly toward the respective lever 2. The cam keepers 1*f* are cantilevered at the fore ends of the arms 1*a*′, with the connection of the respective arm to the side of the lower bottom portion 1*b* serving as; the fulcrum.

Figure 1:
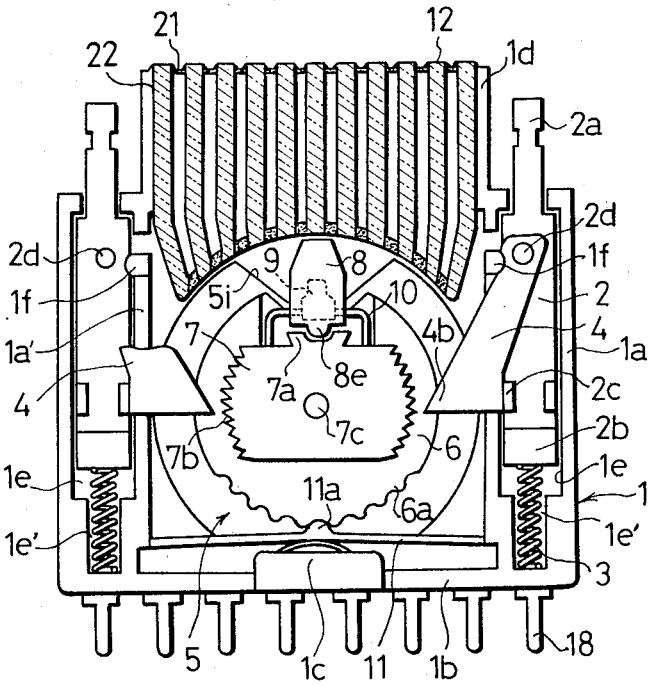
FIG. 1 is a top view showing the interior of a rotary variable resistor.

The fore ends of the levers 2 received in the respective recesses 1*e* form operating portions which project out from the case 1. The rear end of each lever 2 is provided with a cylindrical portion 2*b*, which bears one end of the respective coiled springs 3. A stopper 2*c* formed on each respective lever 2 serves to control the swiveling of cams 4 to be described below. Each cam 4 is made of a single metal plate pivotally mounted at its upper end to a respective protuberance 2*d* formed on each lever 2. When the levers 2 are not pressed inwardly of the case, the upper end portion of each cam 4 is held in engagement with the respective cam keeper 1*f* of the arms 1*a*′, and its lower end portion has its outward movement restrained by the stoppers 2*c* of the respective levers 2, as shown in FIG. 1. Tapered edge portions 4*b* of the cams 4 angle inwardly of the case form the levers 2. Numeral 5 indicates a slider holder which is made of an insulating synthetic resin. The slider holder 5 is unitarily formed with a disc-shaped spacer portion 6 which has a plurality of cam portions 6*a* formed along the lower part of its peripheral surface, and a toothed wheel portion 7 which overlies the spacer 6 and which is provided with a plurality of small tooth portions 7*b* at opposing peripheral surface portions. Symbol 5*i* represents a notch which is provided in the upper portion of the slider holder 4, and symbol 7*a* a bifurcated engaging portion which is provided at the upper part of the toothed wheel 7. A pointer frame 8 which receives a light emitting diode 9 therein is arranged in the notch 5*i*. Terminals 10 of the light emitting diode 9 are attached to the spacer 6.

Figure 2:
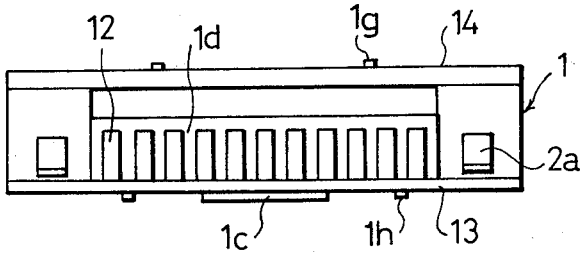
FIG. 2 is a front view of the rotary variable resistor.

Numeral 11 indicates a leaf spring member which is held between the opposing arns 1*a*′ in proximity to the lower wall portion 1*b* of the case 1. A projection 11*a* which is provided substantially in the middle of the spring member 11 is removably engaged with the cam portion of the spacer 6 to give the slider holder 5 a proper torque and to control the stop position of the slider holder 5. Numeral 12 denotes a plurality of optical guide members such as glass fibers held to in the upper overhang 1*d* of the case 1 at predetermined intervals. The lower end faces of the optical guide members 12 are arranged in an arcuate pattern around the top of the slider holder 5, while the upper end faces thereof are aligned in a parallel arrangment along the top end of the overhand 1*d*, as shown in FIG. 2. Numeral 13 indicates an insulating cover which closes the open surface of the case 1, and numeral 14 an insulating base plate which closes the other open surface of the case 1. The cover 13 and the insulating base plate 14 are mounted on the case 1 by, for example, welding a plurality of small projections 1*g* and 1*h* provided in the case top portion 1*d*. The lower end of the cover 13 is held by the overhang 1*c* of the bottom portion 1*b* of the case 1.

Figure 3:
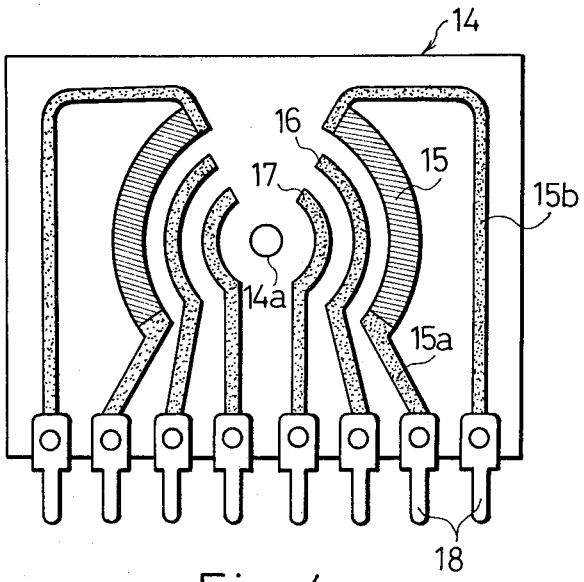
FIG. 3 is a plan view of the insulating base plate.

The insulating base plate 14 is specifically shown in FIG. 3. Around a central shaft hole 14*a*, there are disposed a pair of arcuate resistors 15 which are concentric with the shaft hole and each of which has its end parts connected to terminals 18 by leads 15*a* and 15*b*, respectively. A pair of arcuate and concentric leads 16 and 17 are spaced inwards radially of each resistor 15. The leads 16 and 17 are connected respectively to corresponding terminals 18. The resistors 15 and the leads 16 close thereto form a variable resistance circuit. Further, the pair of inner leads 17 form a circuit for supplying current to the light emitting diode 9.

Figure 4:
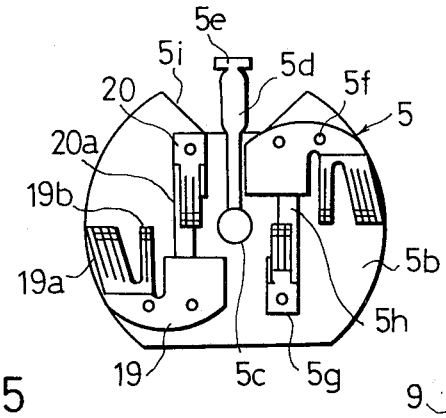
FIG. 4 is a bottom view of the slider holder.

Referring now to the plan view of FIG. 4, a pair of sliders 19 and 20 which are adapted to come into sliding contact with the resistor 15 and the leads 16 and 17 of the insulating base plate 14 are mounted on the rear surface 5*b* of the slider holder 5.

Figure 8:
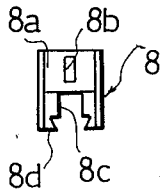
FIG. 8 is a bottom view of the pointer frame.
Figure 9:
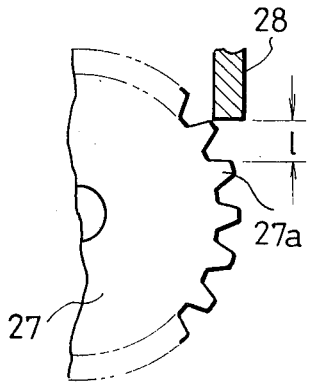
Fig. 9 PRIOR ART
FIG. 9 is a view for illustrating the operating state of a prior-art rotary variable resistor.

Symbol 5*c* represents a supporting shaft which is carried in the shaft hole 14*a* of the base plate 14. Symbol 5*d* represents a columnar protrusion for mounting the pointer frame 8 receiving the light emitting diode 9 therein. As shown in FIG. 8, wherein the pointer frame 8 is seen from a side on which the light emitting diode is inserted, symbol 8*a* denotes a cavity for receiving the light emitting diode 9, symbol 8*b* a hole for transmitting the light of the light emitting diode 9, and symbol 8*c* a pair of engaging arms each having a engaging hook 8*d* at its fore end which are shaped so as to snap over the engaging portion 5*e* of the protrusion 5*d*. In mounting the pointer frame 8 on the slider holder 5, the cavity 8*a* of the frame 8 is placed over the light emitting diode 9 held on the slider holder 5 in advance, and the pointer frame 8 is engaged by a snap fit with the engaging portion 5*e* of the columnar protrusion 5*d* in a manner to spread out the engaging arms 8*c*. Then, the leg portion 8*e* of the pointer frame 8 is fitted with the bifurcate engaging portion 7*a* of the toothed wheel 7 as shown in FIG. 1.

Figure 5:
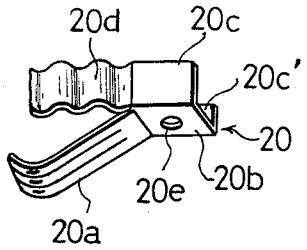
FIG. 5 is a perspective view showing the slider.
Figure 6:
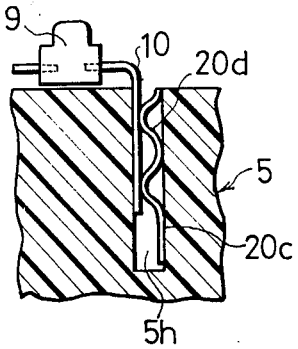
FIG. 6 is a side sectional view of essential portions showing the state in which a light emitting diode is mounted on the slider holder.

As best shown in FIG. 4, the slider 19 for the variable resistor is made of a single resilient metal plate and has a plurality of branched contactor pieces 19*a* and 19*b*. It is caulked to the rear surface 5*b* of the slider holder 5 by protrusions 5*f*. One of the contactor pieces 19*a* comes into sliding contact with the resistor 15 of the insulating base plate 14, and the other contactor piece 19*b* contacts the lead 16, thereby to vary the resistance value of the variable resistor. As shown in FIG. 5, the other slider 20 is constructed of a mounting portion 20*b* which is provided with a caulking hole 20*e* for the protrusion 5*g* of the slider holder 5, a plurality of contactor pieces 20*a* which extend downwardly from the mounting portion in a curved manner, a pair of engaging pieces 20*c* and 20*c*' which extend upwardly from the mounting portion, and a contact plate 20*d* which extends from one engaging piece 20*c* horizontally and has a generally sinuous shape. As shown in FIG. 6, the engaging piece 20*c* and the contact plate 20*d* are loaded in a square recess 5*h* formed in the rear surface 5*b* of the slider holder 5, and the sinuous contact plate 20*d* lies in resilient contact with the terminal 10 of the light emitting diode 9 within the recess 5*h*. Accordingly, the contactor pieces 20*a* of the slider 20 come into sliding contact with the lead 17 of the insulating base plate 14, whereby the contact plate 20*d* and the pair of terminals 10 of the light emitting diode 9 are electrically conducted. In accordance with the turning of the slider holder 5, the light emitting diode 9 and the pointer frame 8 receiving it therein turn in the same direction. When the pointer frame 8 successively comes into opposition to the lower ends of each optical guide members 12 shown in FIG. 1, the light of the light emitting diode transmitted through the hole 8*b* of the upper surface of the pointer frame 8 is propagated to the upper end part of the respective guide members 12 and can be seen at the top portion 1*d* of the case 1.

Figure 7:
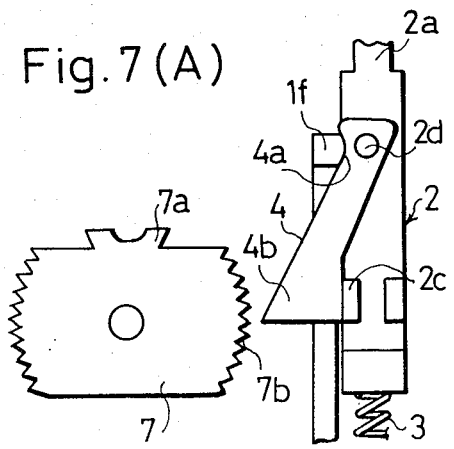
FIGS. 7A to 7E are explanatory views for illustrating the operating states between the cam and the toothed wheel.
Figure 7:
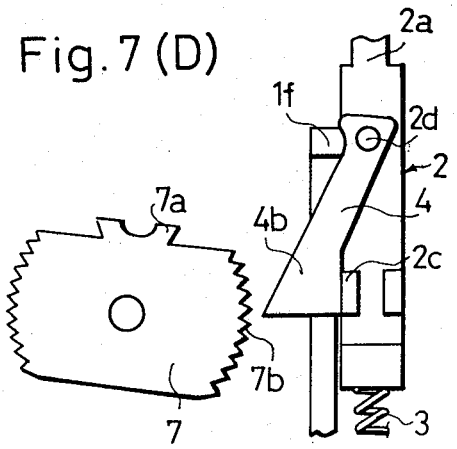
Figure 7:
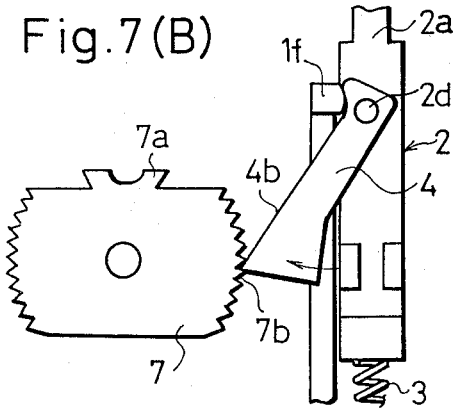
Figure 7:
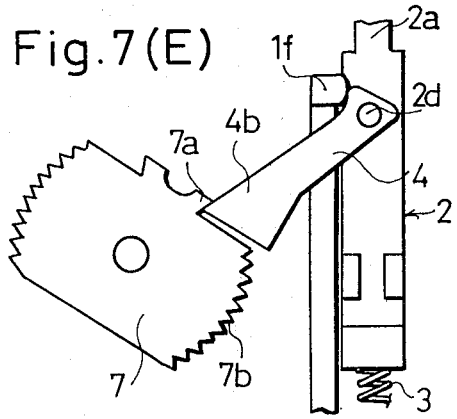
Figure 7:
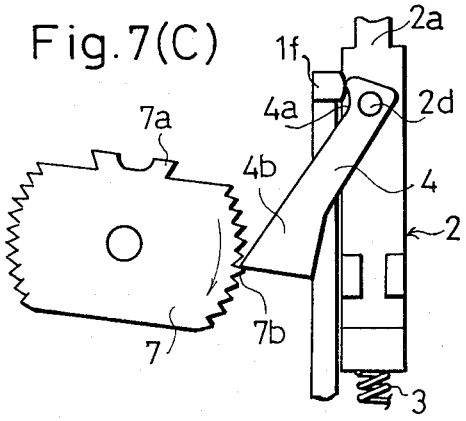

The present invention is constructed as described above. Now, the operation will be described with reference to FIGS. 7A to 7E. FIG. 7A corresponds to the state of FIG. 1. When, in this state, the operating portion 2*a* of the lever 2 is pressed inwardly of the case 1, the cam 4 pivots in the direction of the arrow about the fulcrum 2*d* under the action of the cam keeper 1*f*, as illustrated in FIG. 7B. That is, an indent 4*a* of the cam 4 moves along the side surface of the cam keeper 1*f*, and the edge portion 4*b* of the cam 4 moves leftwardly to come into engagement with a tooth portion 7*b* of the toothed wheel 7 as shown in the figure. When, in this state, the lever 2 is further depressed, the edge portion 4*b* of the cam 4 is moved downwardly so as to turn the toothed wheel 7 in the direction of the arrow (FIG. 7C), and the slider holder 5 moves along with the toothed wheel 7 one step.

At this time, simultaneously with the turning of the toothed wheel 7, the cam portion 6*a* of the spacer 6 fitting within the projection 11*a* moves past the projection 11*a* of the spring member 11. Thus, tactility is afforded.

When, under this state, the depression of the lever 2 is released, the toothed wheel 7 stops in the state in which it has turned a predetermined angle as shown in FIG. 7D. The cam 4 and the lever 2 are restored to their initial positions by the resilience of the coiled spring 3, and the cam 4 abuts against the stopper 2*c*.

By successively moving either of the levers 2 up and down in this manner, the slider holder 5 can be rotated in accordance with the toothed wheel 7 and in the same direction as that of the latter, and the resistance value of the resistor 15 can be varied by the slider 19. Simultaneously, owing to the turning of the pointer frame 8 receiving the light emitting diode 9 therein, the adjustment position of the resistance value is indicated on the upper end face of the case 1 via the corresponding optical guide member 12 embedded in the overhang top portion 1*d* of the case 1.

When the slider 1*a* has reached the end position of the resistor 15, of the cam does not engage tooth portion 7*b*, but reaches the side part of the bifurcate engaging portion 7*a* of the toothed wheel 7, as shown in FIG. 7E. In this state, the toothed wheel 7 is prevented from turning any more in the same direction. When the other lever 2 is moved up and down, the slider holder 5 is turned counterclockwise on the basis of the same principle as stated before. By selectively operating the pair of levers 2, disposed on the opposing sides of the case 1, in this way, the slider holder 5 and the pointer frame 8 can be turned through predetermined angles clockwise and counterclockwise, and the resistance values of the pair of resistors 15 can be adjusted mutually and selectively. The adjustment positions of the resistance values are displayed on the upper end face of the case 1 by the single light emitting diode 9.

As set forth above, the rotary variable resistor of the present invention is so constructed that a pair of levers are arranged in a case, that one end part of a cam is pivotally mounted on the projection of each lever, and that in accordance with the movement of the lever, the cam comes into engagement with tooth portions of a toothed wheel so as to turn a slider holder. Therefore, the play are stroke of the lever can be made smaller than in the prior-art structure, and the moving stroke of the lever can be lessened. In addition, the slider holder can be turned through every small angles. The present invention can achieve such functional effects remarkably in practical use.

I claim:

1. A rotary variable resistor comprising a case; two levers arranged on opposite sides of said case; two cams each having one end pivotally mounted on a respective one of said levers, said cams each being formed with an indent in a position close to the pivotal connection to the respective lever; two cam keepers formed in said case and adapted to engage a respective one of said indents; a slider holder carrying a toothed wheel rotatably arranged in a central part of said case; sliders mounted on said slider holder and adapted to engage arcuate resistors formed on an insulating base plate; said levers being vertically moved to cause the edge portions of the corresponding cam to pivot said toothed wheel and said slider holder and thus cause said sliders to slide on said arcuate resistors, whereby a resistance value of said variable resistor can be varied.

2. A rotary variable resistor according to claim 1, wherein a light emitting device is mounted on said slider holder, and its leads are formed concentrically with said arcuate resistors formed on said insulating base plate.

3. A rotary variable resistor according to claim 2, wherein a plurality of cam portions are integrally formed at an outer periphery of said slider holder, and a spring member provided with a projection abutting the cam portion is arranged in said case.

4. A rotary variable resistor according to claim 1, further including means providing an illuminable display for indicating the rotary position of said slider holder, said display means including illuminable means carried by said slider holder and adapted to move in an arcuate path during rotation thereof for emitting light, and a plurality of elongate light-transmitting members each extending from said arcuate path to a location external of said case, said light-transmitting members each having an arcuate end portion conforming to the curvature of said path and extending to respective elongate portions lying parallel to one another in side-by-side relation externally of said case.

5. A rotary variable resistor according to claim 4, wherein said light-transmitting members are spaced from one another.

* * * * *